United States Patent [19]

Lacza

[11] Patent Number: 5,011,160

[45] Date of Patent: Apr. 30, 1991

[54] METHOD OF PLAYING A PROBABILITY GAME

[76] Inventor: Joseph Lacza, 27303 Westown Blvd., Westlake, Ohio 44145

[21] Appl. No.: 420,012

[22] Filed: Oct. 11, 1989

[51] Int. Cl.[5] ..... A63F 3/00

[52] U.S. Cl. ..... 273/268; 273/282

[58] Field of Search ..... 273/258, 264, 266, 267, 273/270, 269, 282, 268

[56] References Cited

U.S. PATENT DOCUMENTS

| | | | |
|---|---|---|---|
| 1,740,799 | 12/1929 | Vondersaar | 273/264 |
| 3,743,293 | 7/1973 | Chodorov et al. | 273/266 |
| 4,136,882 | 1/1979 | Odza et al. | 273/264 |
| 4,200,298 | 4/1980 | Lamke | 273/266 X |
| 4,208,054 | 6/1980 | Hahn, Jr. et al. | 273/258 |
| 4,210,337 | 7/1980 | Obermair | 273/264 |
| 4,371,170 | 2/1983 | Acevedo | 273/271 |
| 4,456,261 | 6/1984 | Daitzman | 273/271 |
| 4,506,893 | 3/1985 | Perry | 273/258 |
| 4,613,134 | 9/1986 | Tobin | 273/242 |
| 4,852,887 | 8/1989 | Li | 273/264 |

*Primary Examiner*—Edward M. Coven
*Assistant Examiner*—William Stoll
*Attorney, Agent, or Firm*—Fay, Sharpe, Beall, Fagan, Minnich & McKee

[57] ABSTRACT

A game for two or more players includes a playing board, having a plurality of spaced playing positions identified by different indicia, two or more sets of moveable playing pieces and a random indicium generator such as a die. When playing the game, a first player obtains an indicium and positions one of his pieces on the board playing position identified by that indicium. The first player then proceeds to obtain a second indicium and positions another of his pieces in the board playing position identified by the second indicium. If the second indicium is the same as the first indicium, the first player removes his piece already on the board and gives way to the second player. Otherwise, the first player keeps on playing until he runs out of pieces, or he has to remove a player piece, or he decides to give way to the second player. The second player similarly obtains an indicium and positions one of his pieces on the board playing position identified by the indicium obtained. However, if position is already filled by a player piece, it must be removed and added to the second player's pieces. It then becomes the next player's turn. Otherwise, the second player keeps playing until he runs out of pieces, or he has to remove one of the pieces on the board or he decides to give way to the first player. The winner of the game is the player who first runs out of pieces.

5 Claims, 2 Drawing Sheets

METHOD OF PLAYING A PROBABILITY GAME

BACKGROUND OF THE INVENTION

This invention generally relates to board games. More specifically, the present invention relates to a board game in which at least two opposing players move game pieces on a board as dictated by a random number generator.

A vast number of board games, which can be employed by two or more players and in which pieces are placed upon or moved about the surface of a playing board, are known in the prior art. Various games have been developed which each follow a unique set of rules and are designed to provide entertainment and a challenge to the participants.

However, the need exists for a game which is relatively simple to master and is suitable for play by various age groups but which game, nevertheless, provides a challenge for adults since a great deal of strategy may be employed in playing the game. Ideally, the game should be playable in different ways for maximum enjoyment.

Accordingly, it has been considered desirable to develop a new and improved game which would overcome the foregoing difficulties and others and meet the above-stated needs while providing better and more advantageous overall results.

BRIEF SUMMARY OF THE INVENTION

In accordance with the present invention, a new and improved method is provided for playing a game by two or more players on a playing board having a plurality of spaced playing positions which are each identified by a different indicium. The game further includes two sets of moveable pieces, one set for each player, as well as a random indicium generator.

The method comprises a first player obtaining an indicium and then positioning one of his pieces on the board at a playing position identified by the indicium obtained. The first player then obtains a second indicium and positions another of his pieces on the board at a playing position identified by the second indicium. If the second indicium is the same as the first indicium the first player has to remove his one piece from the board and give way to the second player. The first player otherwise keeps playing until he (a) runs out of pieces or (b) has to remove one of the playing pieces from the board or (c) decides to pass to the second player. When it is the second player's turn, he obtains an indicium and positions one of his pieces on the board at a playing position identified by the indicium obtained. If the playing position identified is already filled by either one of the first player's pieces or one of the second player's pieces, it is removed and added to the second player's collection of pieces. The second player must then pass to the first player. Otherwise, the second player keeps playing until he (a) runs out of pieces or (b) he has to remove one of the pieces from the board or (c) he decides to pass to the first player. The winner of the game is the player who first runs out of pieces.

According to another aspect of the invention, a game is provided for two or more players.

More particularly, the game comprises a playing board including a plurality of spaced playing positions which are each identified by a unique identifier, such as a number or letter. First and second sets of player pieces are provided wherein each set has an equal number of pieces at the beginning of the game. A random identifier generator is provided for generating an identifier corresponding to one of the identifiers on the playing board.

According to still another aspect of the invention, a game is provided for at least two players.

The game comprises a plurality of player pieces including an equal number of player pieces for at least two players. A game board includes a plurality of spaced playing positions, each of which is identified by a different indicium and wherein only one player piece can be accommodated at each spaced playing position. One of the playing positions leads to an off the board storage area. A die is provided for selecting, upon each roll thereof, one of the playing positions.

According to yet another aspect of the invention, a game for two players is provided.

More particularly in accordance with this aspect of the invention, the game comprises a game board including a plurality of spaced playing positions, each of which is identified by a different indicium. A random indicium generator is provided for generating an indicium of one of the spaced playing positions. A button is provided for use by a first and a second player to activate the random indicium generator. An indicator window means indicates to the first and second players how many playing pieces each has left. Each of the spaced playing positions has an indicating means to indicate if a playing piece of one of the first and second players is occupying that playing position.

One advantage of the present invention is the provision of a new and improved game.

Another advantage of the invention is the provision of a game which is simple to learn and can be played by all age groups, yet which has sufficient complexity that it can be enjoyed by adults.

Still another advantage of the present invention is the provision of a game which is simple and inexpensive to manufacture.

Yet another advantage of the present invention is the provision of a game which can be played in a number of different ways as desired by the participants.

A further advantage of the present invention is the provision of a game which can be played either manually or on a computer.

A still further advantage of the present invention is the provision of a game which can be played either with a simple die or with a plurality of poker dice.

A yet further advantage of the present invention is a game which can be adapted for play on a gambling machine.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts preferred and alternate embodiments of which will be described in detail in this specification and illustrated in the accompanying drawings which form a part hereof and wherein.

DETAILED DESCRIPTION OF THE PREFERRED AND ALTERNATE EMBODIMENTS

Figure 1:
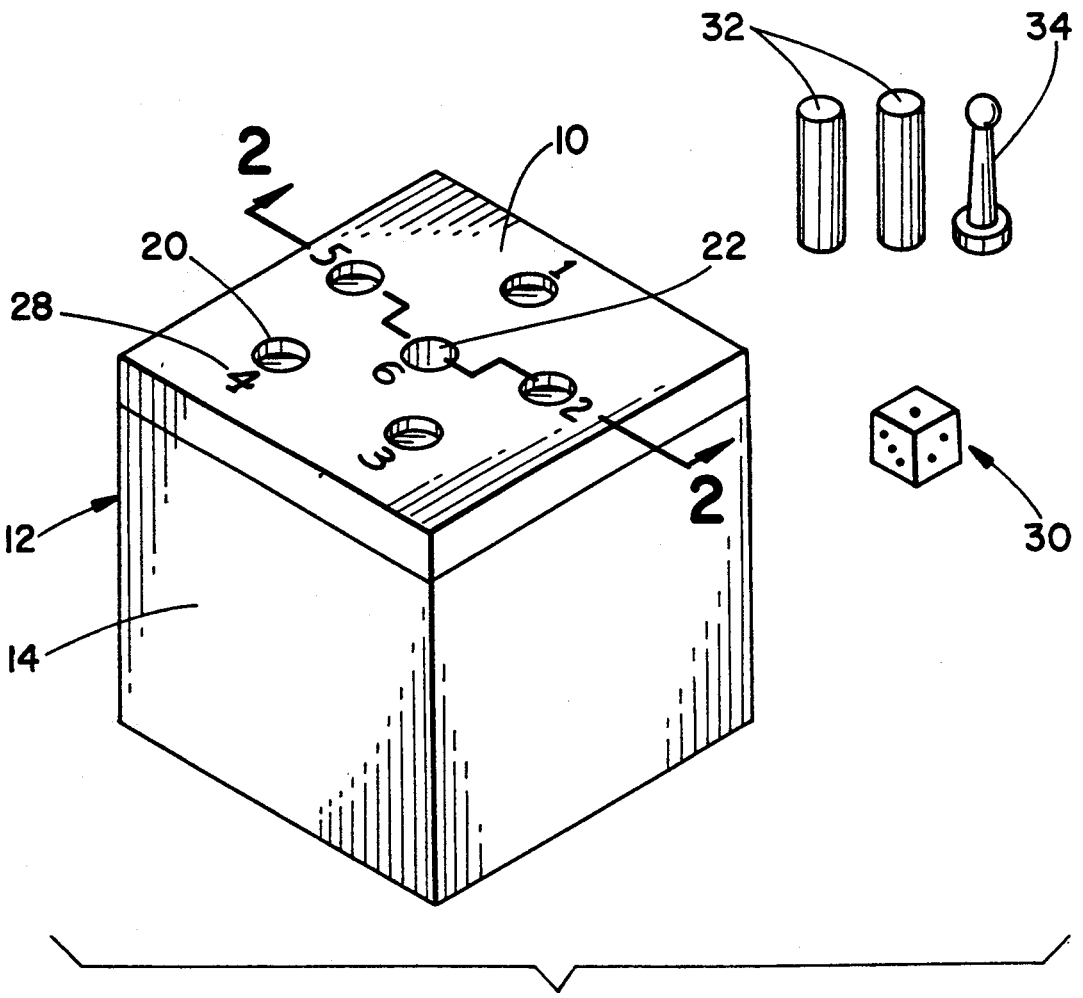
FIG. 1 is a perspective view of a first preferred embodiment of the game according to the present invention.

Referring now to the drawings wherein the showings are for purposes of illustrating preferred and alternate embodiments of the invention only and not for purposes of limiting same, FIG. 1 shows the preferred embodiment of the subject new game. While the game is primarily designed for and will hereinafter be described as being used with a conventional single die cube and having therefore only six spaced playing positions, it should be appreciated that a die with more than six playing surfaces, such as an octagonal die could be provided. In that case, eight playing positions would be used. Additionally, an enlarged game utilizing, for example, two dice and twelve playing positions could also be provided.

Figure 2:
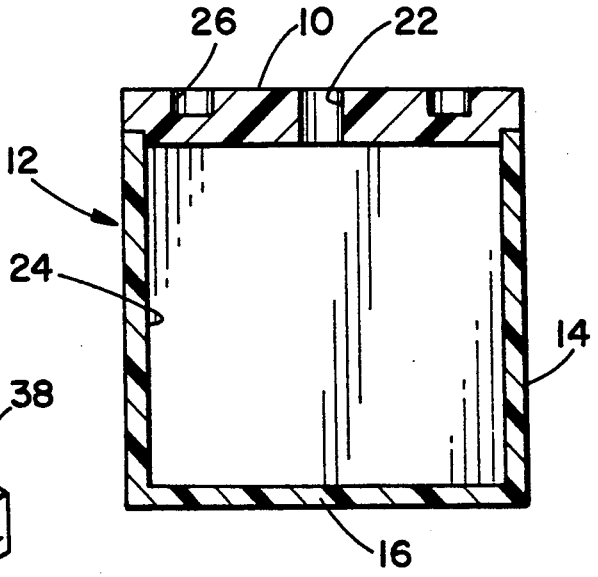
FIG. 2 is a side elevational view in cross section of the game of FIG. 1 along line 2—2.

The game includes a game board 10 which could be the top panel of a box 12 also having a plurality of side walls 14 as well as a bottom wall 16 as better seen in FIG. 2. Provided on the game board 10 are a plurality of spaced playing positions 20. One of the playing positions 22 is apertured such that it leads to a cavity 24 formed within the box. If desired, each of the playing positions 20 could be formed by a depression 26 in the box top wall as is illustrated in FIG. 2. Located adjacent each of the playing positions 20 is an indicium 28 which identifies that position. In the preferred embodiment, the indicia are numbers and each position 20 is given a different number.

When a random number or character or other indicium generator used with the game is a conventional cubical die 30, the numbers are those on the conventional die, i.e., the numbers 1, 2, 3, 4, 5 and 6. It should be appreciated that the indicia could also be letters, geometric symbols or the like. In the embodiment illustrated, the apertured playing position 22 is associated with the number 6.

Each player is provided with a plurality of player pieces 32. In this game, however, it is not necessary that one player's pieces can be distinguished from another player's pieces by a differentiating indicium. However, if desired, a different color, or a different shape, such as is illustrated at 34 could be used. The player piece can be a simple cylinder or the pawn of a chess set or any similar desired type of piece. However, the piece should have a bottom diameter of a suitable size that the piece can fit within the depressions 26 in the top wall of the box, if such depressions are provided.

A first version of the game is played as follows: each player is given ten player pieces. To determine who will begin the game, the players each roll the die 30 and the player who rolls the highest number will begin the game. If the same number is rolled by two or more players, those players will roll again until different numbers are obtained by the players.

The player chosen to start then rolls the die and obtains a number. The player thereupon positions one of his playing pieces on the board at the position identified by the number. For example, if the player rolls the number 5, he places one of his pieces in the playing position identified by the number 5.

Thereafter, the first player rolls again. If this time he rolls a 6, then he places another of his player pieces in the playing position identified by the number 6. As this is the apertured playing position 22 illustrated in the drawings, that playing piece falls into the cavity 24 and is removed from further play in the game. The first player then continues to roll. If this time, the first player rolls another 5 with the die, then, since the player already has a player piece in the playing position identified by the number 5, he will be forced to take that player piece out, add it to his supply of pieces. Further, the first player must then give way to the second player. Otherwise, the first player can continue to play until he (a) runs out of pieces, (b) he has to remove one of the pieces from the board, or (c) he decides to give way to the second player.

The second player thereupon rolls the die and obtains a number. Let us assume it is the number 2. Thus, the second player will then place one of his player pieces 32 in the playing position 20 identified by the number 2. If the second player rolls a number which identifies a playing position which is filled by one of the player pieces of the first player, the second player must remove that player piece, and add it to his supply of pieces and give way to the next player. If there are only two players, that would again be the first player. If there are more than two players it would be a third player. The second player can continue to keep playing until he (a) runs out of pieces or (b) he has to remove one of the pieces from the board or (c) he decides to give way to the next player.

The strategy of the game resides in the fact that once three or four of the playing positions 20 are occupied by player pieces 32, the odds of the player rolling a number such that it corresponds to one of the unoccupied playing positions is greatly decreased. Therefore as a matter of strategy, the player may decide to pass the die along to the next player, rather than risk adding to his own supply of player pieces. In other words, if the playing positions identified by the numbers 2, 3, 4, and 5 are filled, then a player would need to roll either a 1 or a 6 in order to continue to play. The odds of that happening are 1 in 3, i.e., 33%. Therefore the player may decide to pass the die along to the second player rather than continuing to roll. However, each player must throw the die 30 at least once each time it is his turn to play. Thereafter, that player can pass if he wants to.

An additional rule in the game is that if the player only has one player piece left, then that player must roll the die and is not given the opportunity to pass the die along to the next player, even if he just finished an earlier roll.

The winner of the game is the player who first runs out of player pieces, by having all of his pieces either fall into the cavity 24 upon rolling the number 6, or by having all of his remaining player pieces located at one or more of the playing positions 20 on the game board 10.

One way of playing the game is to play seven rounds to determine an eventual winner. In such a game and when it is played, for example, by four players, the scoring would be as follows:

| | + | − |
|---|---|---|
| First player | 4 | |

-continued

| | + | − |
|---|---|---|
| Second player | 3 | |
| Third player | 2 | |
| Fourth player | | 6 |

The meaning of this table is that the first player finishing the game has accumulated plus 4 points, the second player finishing receives plus 3 points and the third player gets plus 2 points. The last player in the particular game has a minus score instead of a plus score. The minus score is determined by the number of player pieces he still has left when the other three players have already departed the game, in this case, six pieces and thus minus 6 points. When seven such subgames are played, the scores are totaled for the seven games with the minus points being deducted from the plus points. The player who has obtained the largest positive score is the winner of the overall game.

Another way of playing the game is to have rules which are the inverse of the previous game. For this game each player will start the game with ten pieces but the object of the game is to accumulate pieces, not to get rid of them. Accordingly, the winner will be the last player left in the game, not the first player to leave the game as in the previous embodiment.

A player is entitled to roll the die as many times as the player can take player pieces off the game board 10, but not including out of the cavity 24 in the box 12. In other words, if the player rolls a six he needs to put a player piece 32 into the cavity 24 and that piece stays there for the remainder of the game. Opposite the rules of the first game, in this version, the player must then give way to the next player. As in the first game, each player must roll at least once each time it is his turn.

With rules which are the inverse of the first game, the object of the second game is to take player pieces 32 off the board 10 instead of putting them on the board. If the player rolls a number which identifies a playing position on the board where there is already a playing piece, the player is entitled to take that playing piece off the playing board and add it to his supply. The player can then roll a second time if he wishes. If, however, the player rolls a number which identifies a playing position at which there is no player piece, then the player must put one of his pieces at that position and give way to the next player.

Strategy for this game dictates that the player should pass the die if there are only a few player pieces on the board since his chances of getting a piece to add to his supply are small. On the other hand, if most of the positions 20 are filled, excluding the "six" position 24, then it is advantageous to roll the die because the odds are that the player will be able to add pieces to his supply. For example, if the 2, 3, 4, and 5 positions are occupied, the odds are approximately 67% that the player will roll one of these four numbers and hence obtain a piece to add to his supply.

The winner in this game will be the player who has player pieces left at the end of the game. The scoring is as follows:

| | + | − |
|---|---|---|
| First player | 7 | |
| Second player | | 2 |
| Third player | | 3 |

-continued

| | + | − |
|---|---|---|
| Fourth player | | 4 |

In this case, again with four players, the fourth player, the one who leaves the game the earliest, is the loser and gets as many minus points as there are players who play, i.e., the fourth player, the first one out, gets minus 4 points. The third player, the second player out, gets minus 3 points and the third player out gets minus 2 points. The player left in the game, the first player, gets as many plus points as he has player pieces left, in this case, seven.

As in the previous embodiment, seven subgames can be played, if desired, and the winner of the overall game will be the player who has collected the largest numerical score.

Figure 3:
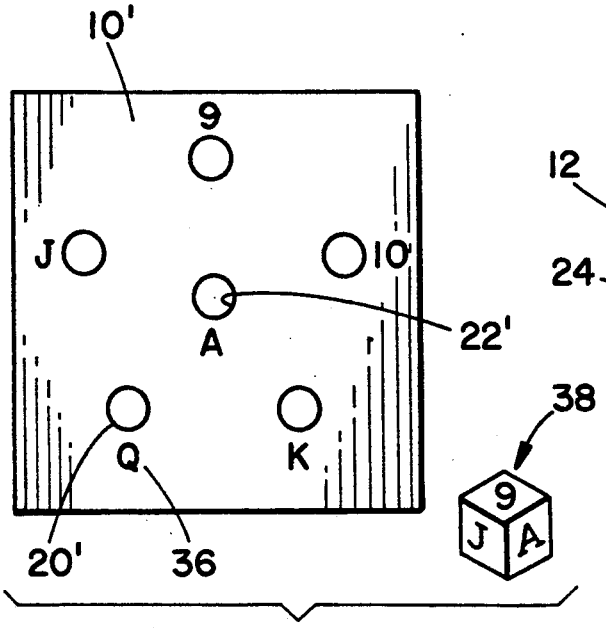
FIG. 3 is a top plan view of a first alternate embodiment of the game according to the present invention.

Yet another way of playing the game is to play it as a poker-type game in which the numerical indicators 28 are replaced by the alphanumeric identifiers of the top six cards of a conventional 52 card playing card deck, i.e., the 9, 10, jack, queen, king and ace. In this game the 9 is worth one point, the 10 is worth 2 points, the jack 3, the queen 4, the king 5 and the ace 6. This type of game is illustrated in FIG. 3. For ease of understanding and appreciation of this alternative, like components are identified by like numerals with a primed suffix (') and new components are identified by new numerals.

It can be seen in FIG. 3 that a game board 10' includes a plurality of playing positions 20' which are each identified by a suitable alpha-numeric indicator 36. One of the playing positions is an apertured playing position 22' which is identified by the letter A for ace. In this type of game the conventional numbered die is replaced by a poker type die 38 which has on its six faces the alpha-numeric designations 9, 10, jack, queen, king, and ace. Preferably five such dice are provided and the object of the game is to roll all of the dice and observe the results in terms of obtaining conventional-type poker hands such as straights, three of a kind, full houses, four of a kind, i.e., poker, and five of a kind, i.e., grand poker. Again, each player gets ten player pieces and the starter is the one who has the highest number on a conventional die or a poker die when the order of play is determined.

In order to play this game, the following table is also necessary:

| Value | Point Count | Player pieces in Ace hole | Player pieces on playing board (as possible) | Plus Points | Minus Points |
|---|---|---|---|---|---|
| 9 | 1 | | | | |
| 10 | 2 | | | | |
| Jack | 3 | | | | |
| Queen | 4 | | | | |
| King | 5 | | | | |
| Ace | 6 | | | | |
| Straight | 20 | 1 | 2 | | |
| Full House | 30 | 2 | 3 | | |
| Poker (4 of a kind) | 40 | 3 | 4 | | |
| Grand Poker (5 of a kind) | 50 | 4 | 5 | | |

-continued

| Value | Point Count | Player pieces in Ace hole | Player pieces on playing board (as possible) | Plus Points | Minus Points |
|---|---|---|---|---|---|
| | | | Total Points | | |

For example:
Three nines are worth 3 points
Two Queens are worth 8 points

If none of the five dice are similar, then the player will not be allowed to place any playing pieces on the board. Playing pieces can only be placed as allowed by the chart. Thus one of the hands identified in the chart needs to be rolled before any pieces are allowed on the board. As in the previous games, if there is already a player piece in a particular position, then the player must take that piece out and add it to his supply. When one of the hands on the chart is rolled, then the player will place whatever player pieces he can.

For example, a player throws a full house with the five poker die and the board position is such that the nine, king and ten positions are occupied, whereas the queen and jack positions are open. Under these circumstances, the player can put two of his playing pieces into the ace playing position and hence into the box cavity thereunder since he is entitled to put two pieces into the ace position because of the full house. However, because he only has two player positions open on the game board, namely the queen and the jack, he can put game pieces only into these game positions. If the game board were completely full, then the player could only put his two playing pieces into the ace hole. On the other hand, if the game board were completely empty, he could place all of the game pieces on the game board as are allowed by the chart. In this case, three pieces.

If the player throws a poker combination with the dice which combination is one he cannot use because he already has written such a combination on the chart or because the combination is unsatisfactory, then he can cross through one of the slots on the chart, usually the slot with the least value. For example, if the player throws the dice and obtains four jacks and a nine with the five dice, he has rolled a poker. But if he already has written down a poker, (e.g., let us say of four aces) on the chart, he can only mark down the largest value he does not already have on the chart. So, in other words, if he has already previously rolled a poker, i.e., four of a kind, and has marked himself for that, he cannot mark himself down for another poker, all he can mark himself down for would be four jacks, i.e., 16 points.

Each player is allowed to roll three times for each turn he has. Within the three rolls, for each roll he can keep certain of the dice. In this way, he continues rolling with the other dice. If the player is satisfied with the first roll that he had, he can tally up his score and pass the five dice along to the next player.

An additional rule in the game can be that the player can receive 5 extra points for each hand shown on the chart when that hand is rolled on the first roll of the dice. In other words, for each of the combinations from straight to grand poker, the player rolling it on the first roll would get five more points than what is shown on the chart. If desired, the player who rolls a straight, full house, poker or grand poker on his first roll can also be rewarded with one extra player piece in the ace hole for each of these respective rolls. In other words, a straight on the first roll could mean two player pieces in the ace hole and a full house three player pieces in the ace hole and so on, if desired.

The game lasts as long as the chart is not filled. For each turn, the player must fill in one of the blocks on the chart. If a player runs through all his player pieces before his chart is filled, he gets 30 extra points. If, on the other hand, he has player pieces left at the end of the game, he gets minus points for as many player pieces as he has. When scoring at the end of the game, the player will add the number of plus points he has received for the various poker hands together with the number of minus points he gets for player pieces left at the end of the game. The game is won by the player who has the most points.

An alternative game which can be played with the board of the present invention is a three dice game which is very popular in Germany. In this game, the three dice are rolled by a first player who then chooses some combination of the digits rolled and the second player then must beat that combination of digits in his turn by rolling either more or less than that combination as the first player directs. For example, if the first player rolls a five, four and three with the three dice, he can direct the second player to roll a combination higher than 543, lower than 345, higher than the sum of the digits, i.e., 12, or lower than the sum of the digits. There are also many additional variations on this game such as one in which the numeral "1" can be worth one hundred as well as one. At any rate, if the second player then beats the first player's combination, then the second player could place one or more of his player pieces in the six hole or somewhere else on the board or force the first player to take certain of his pieces off the board or the like. Obviously, the number and variation of the rules for playing this game in conjunction with the instant game are too numerous to be listed in this specification.

Figure 4:
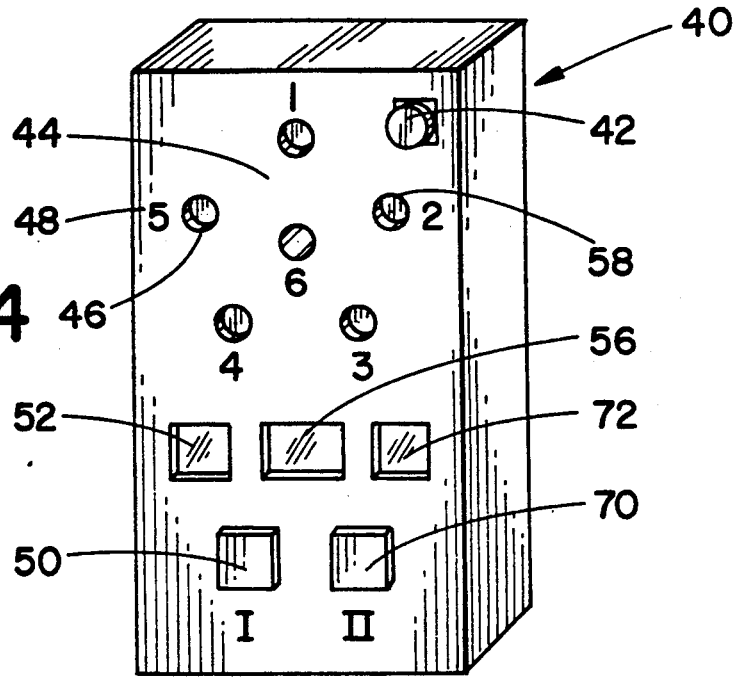
FIG. 4 is a top plan view of the game of FIG. 1 as adapted for play on a hand held computer; and, FIG. 5 is a front elevational view of the game of FIG. 1 as adapted for play on a gaming machine.

With reference now to FIG. 4, another way of playing this game would be with a suitable computer, such as a hand held portable calculator-type computer, 40 having an on/off switch 42 and a game board 44. Provided on the game board are a plurality of playing positions 46 each of which is identified by a suitable alphanumeric indicium 48.

Also provided on the computer adjacent the game board is a first button 50 which can be pushed by the first player and is identified by the roman numeral I therebelow. The pushing of the first button will activate a random number generator provided on a suitable chip (not visible) in the computer. This takes the place of rolling a die. Provided for the first player adjacent the button 50 is a player piece window 52 which indicates how many of the, for example, ten player pieces the player started with, he still has left. The window can be a numerical indicator such as an LED or the like. When pushing the button 50, a die number will be indicated in a die number window 56 of the computer.

Each playing position 48 includes a colored diode 58 to indicate whether that position is filled when the diode lights. A button 70 for the second player is provided adjacent the button 50 for the first player and a player piece window 72 is provided adjacent the button 70 to indicate to the second player how many player pieces he has left.

In this type of game, the first player will push the button 50 which will then indicate what number has been rolled by the random number generator for him, for example, the number 4. At that point, one of his player pieces will be deposited in the playing position 46 identified by the number 4. This will appear to the player in that the colored diode 58 will light in that player position. The first player can continue to roll as long as he wishes until he again rolls a number for a player position he already has. In that case, he has to take back the player piece. In other words, the diode 58 will be de-energized and the player piece window 52 will indicate a number larger by one. Play would then shift to the second player. The winner is the player who first disposes of all his player pieces, as explained above.

It should be recognized that the computer could also be adapted to play the reverse type game described above. Moreover, with suitable modifications, even the poker type game could be played by a suitably configured computer.

Figure 5:
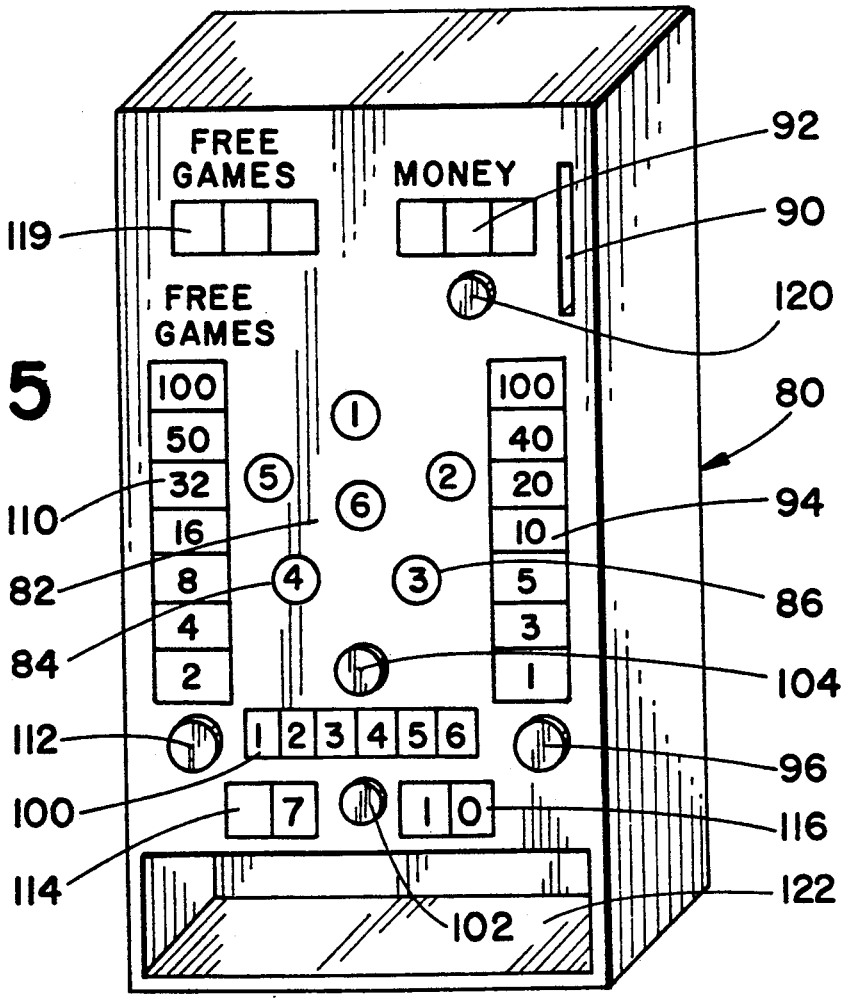

With reference now to FIG. 5, another way of playing this game would be with a suitable gambling machine or the like, as is illustrated in FIG. 5. These machines are extremely popular in Europe and the far east. Such a gambling machine 80 includes a playing board section 82 which has on it six playing positions 84 as previously discussed. In this case, each position is indicated by a bulb 86 on which is scribed one of the numerals 1–6. Also provided is a slot 90 for inserting money into the game and a window 92 which indicates how much money has been bet for the particular game in question. This could be a game played directly against the machine with the player buying a number of opportunities to see if he can dispose of all his playing pieces. There could be a wager multiplier window 94 provided on the machine as illustrated to show what multiple, if any, of the money shown in window 92 is being played for in this particular game.

A button 96 can also be provided which allows the player to increase the money being played for as the machine flashes between two adjacent numbers. If the player pushes the button at the opportune time, the flashing light will stop at the higher of the two numbers thereby increasing the money that is being played for.

The game could also be somewhat a game of skill in that the player could be provided with a window 100 which illustrates the numbers 1–6 and a stop button 102 so as to stop a light which traverses the numbers 1–6, serially or in random fashion. The player in this case would be given the opportunity by pushing the button 102 to stop the light at one of the numbers 100. The object would be to stop the light at a number which has not yet been lit up on the playing board 82 or at the "six" position. In this way, the player could dispose of one or more of his pieces. Obviously, if a player lands on the number 6, he can dispose one piece each time. If the player lands on an unoccupied number, he can place one piece in the position identified by that number. On the other hand, if the player lands on the number which is already lit, then the player will get back the piece which is on that number to begin with.

Also provided is a button 104 which can be pressed to activate the machine during its turn to play.

Generally, also provided with this type of machine is a free game window 110 which indicates how many free games the machine is prepared to give to the player as well as a button 112 which allows the player to increase the number of free games being played for when the machine flashes between two adjacent numbers on the free game window 110. Further provided are a first counter 114 for the player and a second counter 116 for the machine to indicate how many player pieces each of the player and the machine have remaining in their supply.

In this type of game, let us assume that the player initially puts three $1.00 coins in the machine and therefore the play is for $3.00. Both the player and the machine start out with ten player pieces. The player then pushes the machine button 104 in order to allow the machine to select one of the six player positions and place a piece at that position. Thereafter, he pushes the button 102 and allows himself to select one of the six player positions. This starts the light flashing behind the numbers 1–6. The player then pushes the button again in order to stop the light and select a number. This number will then light on the board 82 as a player piece is positioned in that location. Simultaneously, the player's counter window will be decreased by one, e.g., from ten to nine. Then it is the machine's turn again and the player will again push the button 104. The rules of this game are substantially as in the embodiment described with respect to FIGS. 1–3, except that each side only gets one play per turn.

However, in this type of game, if, e.g., there is a three player piece difference between the machine and the player, for example, if the player only has seven pieces left whereas the machine has ten, the machine's software could be so programmed that the machine at this point could vary between the number 3 and the number 5 on the multiplier window 94 indicating to the player that he can increase the amount of money being played for from $3.00 to $5.00 by correctly pushing the button 96. Alternatively, the free game light behind the window 110 could light intermittently on the number 2 indicating to the player that he can obtain two free plays on the machine by correctly timing his pushing of the button 112. The total number of free plays can be shown in a window 119 on the machine. In this way, the player can, as permitted by the machine, increase the amount of money that is being played for and increase the amount of free games that the machine is willing to give him. This is all controlled by suitable software that has been programmed into conventional read only memory chips on a microprocessor chip circuit board that is housed within the machine.

Preferably, there is also provided a button 120 directly underneath the money indicator window 90. The pressing of this button will stop the game as allowed by a machine and enable the player to retrieve all the money which is listed in the money window 92 through a tray 122 provided at the bottom of the machine.

The game can be played in such a manner that the player and the machine are each given ten playing pieces and play can continue until either the player or the machine runs out of player pieces. Normally, such machines are programmed so that the machine will win 60% of the time and allow the player to win only approximately 40% of the time.

It should be apparent to one of ordinary skill in the art that there are a large number of variations that the machine can be programmed for which all incorporate the substance of the games which have been disclosed previously in this specification.

The invention has been described with reference to preferred and alternate embodiments. Obviously, alterations and modifications will occur to others upon a reading and understanding of this specification. It is intended to include all such modifications and alterations insofar as they come within the scope of the appended claims or the equivalents thereof.

Having thus described the preferred and alternate embodiments, the invention is claimed to be:

1. A method for playing a game by two or more players on a playing board having a plurality of spaced playing positions which are each identified by a different indicium, the game further including two sets of movable pieces, one set for each player, and a random indicium generator, the method comprising:

a first player obtaining an indicium;

the first player positioning one of his pieces in the board playing position identified by the indicium obtained;

the first player obtaining a second indicium and positioning another of his pieces at the board playing position identified by the second indicium, wherein if the second indicium is the same as the first indicium the first player has to remove said one of his pieces from the board and give way to a second player, and wherein the first player keeps playing until a) he runs out of pieces or b) he has to remove one of the pieces on the board or c) he decides to give way to the second player;

the second player obtaining an indicium;

the second player positioning one of his pieces at the board playing position identified by the indicium obtained, wherein if the playing position identified is already filled by a player piece, it is removed and added to the second player's supply of pieces, thereupon the second player must give way to the next player;

otherwise, the second player obtaining a second indicium and positioning another of his pieces in the board playing position identified by the second indicium obtained, wherein if the second indicium obtained is the same as the first indicium the second player has to remove said one of his pieces from the playing board and give way to the next player, wherein the second player keeps playing until a) he runs out of pieces or b) he has to remove one of the pieces on the board or c) he decides to give way to the next player;

wherein the winner of the game is the player who first runs out of pieces.

2. The method of claim 1 wherein one of said spaced playing positions includes an opening which leads to a storage chamber under the board and pieces falling through the one opening are removed from the game.

3. The method of claim 1 wherein the step of obtaining an indicium comprises rolling a die.

4. The method of claim 1 wherein the step of obtaining an indicium comprises activating a random indicium generator on a computer.

5. The method of claim 1 wherein before said step of said first player obtaining an indicium, the order of play is established by steps comprising:

obtaining a first indicium by the first player;

obtaining a second indicium by the second player, and;

establishing which indicium has a higher value, wherein whichever player obtains the higher value indicium will start the game and if both indicia are the same, the foregoing steps are repeated until different indicia are obtained by the two players.

* * * * *